US012049888B2

(12) United States Patent
Ohnishi et al.

(10) Patent No.: US 12,049,888 B2
(45) Date of Patent: Jul. 30, 2024

(54) COMPRESSOR

(71) Applicant: DAIKIN INDUSTRIES, LTD., Osaka (JP)

(72) Inventors: Yousuke Ohnishi, Osaka (JP); Mikio Kajiwara, Osaka (JP); Youhei Nishide, Osaka (JP); Naoto Tomioka, Osaka (JP); Masaaki Adachi, Osaka (JP); Daisuke Okamoto, Osaka (JP); Hitoshi Ueda, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/090,301

(22) Filed: Dec. 28, 2022

(65) Prior Publication Data

US 2023/0160383 A1 May 25, 2023

Related U.S. Application Data

(63) Continuation of application No. PCT/JP2021/021618, filed on Jun. 7, 2021.

(30) Foreign Application Priority Data

Jun. 30, 2020 (JP) ..... 2020-113304

(51) Int. Cl.
*F04B 53/08* (2006.01)
*F04B 35/04* (2006.01)
(Continued)

(52) U.S. Cl.
CPC ..... *F04B 53/08* (2013.01); *F04B 35/04* (2013.01); *F04B 39/0238* (2013.01);
(Continued)

(58) Field of Classification Search
CPC .. F04B 35/04; F04B 39/0238; F04B 39/0246; F04B 39/0253; F04C 29/045
(Continued)

(56) References Cited

U.S. PATENT DOCUMENTS 6,234,768 B1 * 5/2001 Harakawa ..... H02K 5/207 417/366
6,533,558 B1 * 3/2003 Matsumoto ..... H02K 1/146 417/410.3
(Continued)

FOREIGN PATENT DOCUMENTS

EP 1 533 527 A1 5/2005
JP 2-4991 U 1/1990
(Continued)

OTHER PUBLICATIONS

International Preliminary Report of corresponding PCT Application No. PCT/JP2021/021618 dated Jan. 12, 2023.
(Continued)

*Primary Examiner* — Christopher S Bobish
(74) *Attorney, Agent, or Firm* — Global IP Counselors, LLP

(57) ABSTRACT

A compressor includes a casing having a cylindrical barrel, a compression mechanism, and an electric motor. The electric motor has a tubular stator, and a rotor disposed inside the stator. The stator has a back yoke forming an outer peripheral portion of the stator, a plurality of teeth extending radially inward, and slots. A fluid passage extends between an outer peripheral surface of the stator and an inner peripheral surface of the barrel. The fluid passage has a plurality of wide portions arranged in a circumferential direction of the stator, and a narrow portion provided between adjacent ones of the wide portions. The narrow portion has a smaller radial width than each of the wide portions. Each wide portion is provided in the outer peripheral surface of the stator and between a core cut having a recessed groove shape between the slots and the inner peripheral surface of the barrel.

8 Claims, 6 Drawing Sheets

(51) Int. Cl.
*F04B 39/02* (2006.01)
*F04C 29/02* (2006.01)
*F04C 29/04* (2006.01)

(52) U.S. Cl.
CPC ..... *F04B 39/0246* (2013.01); *F04B 39/0253* (2013.01); *F04C 29/026* (2013.01); *F04C 29/045* (2013.01)

(58) Field of Classification Search
USPC ..... 417/902
See application file for complete search history.

(56) References Cited

U.S. PATENT DOCUMENTS

| | | | | |
|---|---|---|---|---|
| 6,836,051 | B2 * | 12/2004 | Hiwaki | H02K 1/185 310/254.1 |
| 6,997,687 | B2 * | 2/2006 | Iritani | F04B 39/064 310/62 |
| 7,044,719 | B2 * | 5/2006 | Yanagisawa | F04C 23/008 417/410.5 |
| 7,164,218 | B2 * | 1/2007 | Kimura | F04C 23/008 310/58 |
| 8,569,924 | B2 * | 10/2013 | Yasuda | H02K 1/146 310/216.069 |
| 9,929,607 | B2 * | 3/2018 | Kataoka | F04B 39/0238 |
| 10,590,933 | B2 * | 3/2020 | Komai | F04C 23/008 |
| 10,931,158 | B2 * | 2/2021 | Shono | H02K 9/08 |
| 11,349,355 | B2 * | 5/2022 | Seo | H02K 1/148 |
| 2009/0100861 | A1 * | 4/2009 | Higuchi | F04C 29/028 62/468 |
| 2010/0196185 | A1 | 8/2010 | Higuchi et al. | |

FOREIGN PATENT DOCUMENTS

| | | | |
|---|---|---|---|
| JP | 8-65961 | A | 3/1996 |
| JP | 2000-179463 | A | 6/2000 |
| JP | 2009-47161 | A | 3/2009 |
| JP | 2019-15241 | A | 1/2019 |
| WO | 2015/056364 | A1 | 4/2015 |

OTHER PUBLICATIONS

International Search Report of corresponding PCT Application No. PCT/JP2021/021618 dated Aug. 3, 2021.
European Search Report of corresponding EP Application No. 21 83 3778.0 dated Oct. 9, 2023.
Chinese Office Action of corresponding Chinese Application No. 202180045786.7 dated Jun. 1, 2023.

* cited by examiner

COMPRESSOR

CROSS-REFERENCE TO RELATED APPLICATIONS

This is a continuation of International Application No. PCT/JP2021/021618 filed on Jun. 7, 2021, which claims priority to Japanese Patent Application No. 2020-113304, filed on Jun. 30, 2020. The entire disclosures of these applications are incorporated by reference herein.

BACKGROUND

Technical Field

The present disclosure relates to a compressor.

Background Art

The compressor described in Japanese Unexamined Patent Publication No. 2009-47161 includes a casing having a cylindrical shell plate, a motor provided inside the casing, and a compression element provided below the motor. The motor includes a tubular stator core and a rotor provided inside the stator core. Core cuts extending in the axial direction of the stator are provided in the outer peripheral surface of the stator core. Refrigerant gas discharged from the compression element passes through the core cuts, and flows out of the compression element into the upper space inside the casing.

SUMMARY

A first aspect of the present disclosure is directed to a compressor including a casing, a compression mechanism, and an electric motor housed in the casing. The casing has a cylindrical barrel. The casing is configured to store lubricant at a bottom of the casing, the casing being in a form of a closed container. The compression mechanism is housed in the casing. The compression mechanism is configured to compress a fluid sucked and to discharge the compressed fluid into an internal space of the casing. The electric motor is configured to drive the compression mechanism. The electric motor has a tubular stator along an inner peripheral surface of the barrel, and a rotor disposed inside the stator. The stator has a back yoke forming an outer peripheral portion of the stator, a plurality of teeth extending radially inward from an inner peripheral surface of the back yoke, and slots each surrounded by adjacent ones of the teeth and the back yoke. A fluid passage extends from one end to an other end of the stator between an outer peripheral surface of the stator and the inner peripheral surface of the barrel. The fluid passage is configured to pass the fluid discharged from the compression mechanism therethrough. The fluid passage has a plurality of wide portions arranged in a circumferential direction of the stator, and a narrow portion provided between adjacent ones of the wide portions. The narrow portion has a smaller width in a radial direction of the stator than each of the wide portions. The narrow portion is provided between an outer surface of the slots in the outer peripheral surface of the stator and the inner peripheral surface of the barrel. The plurality of wide portions each is provided in the outer peripheral surface of the stator and between a core cut having a recessed groove shape recessed radially inward between adjacent ones of the slots and the inner peripheral surface of the barrel.

DETAILED DESCRIPTION OF EMBODIMENT(S)

Embodiments of the present invention will now be described in detail with reference to the drawings. Note that the following description of embodiments is merely an example in nature, and is not intended to limit the scope, applications, or use of the present invention.

EMBODIMENT

Figure 1:
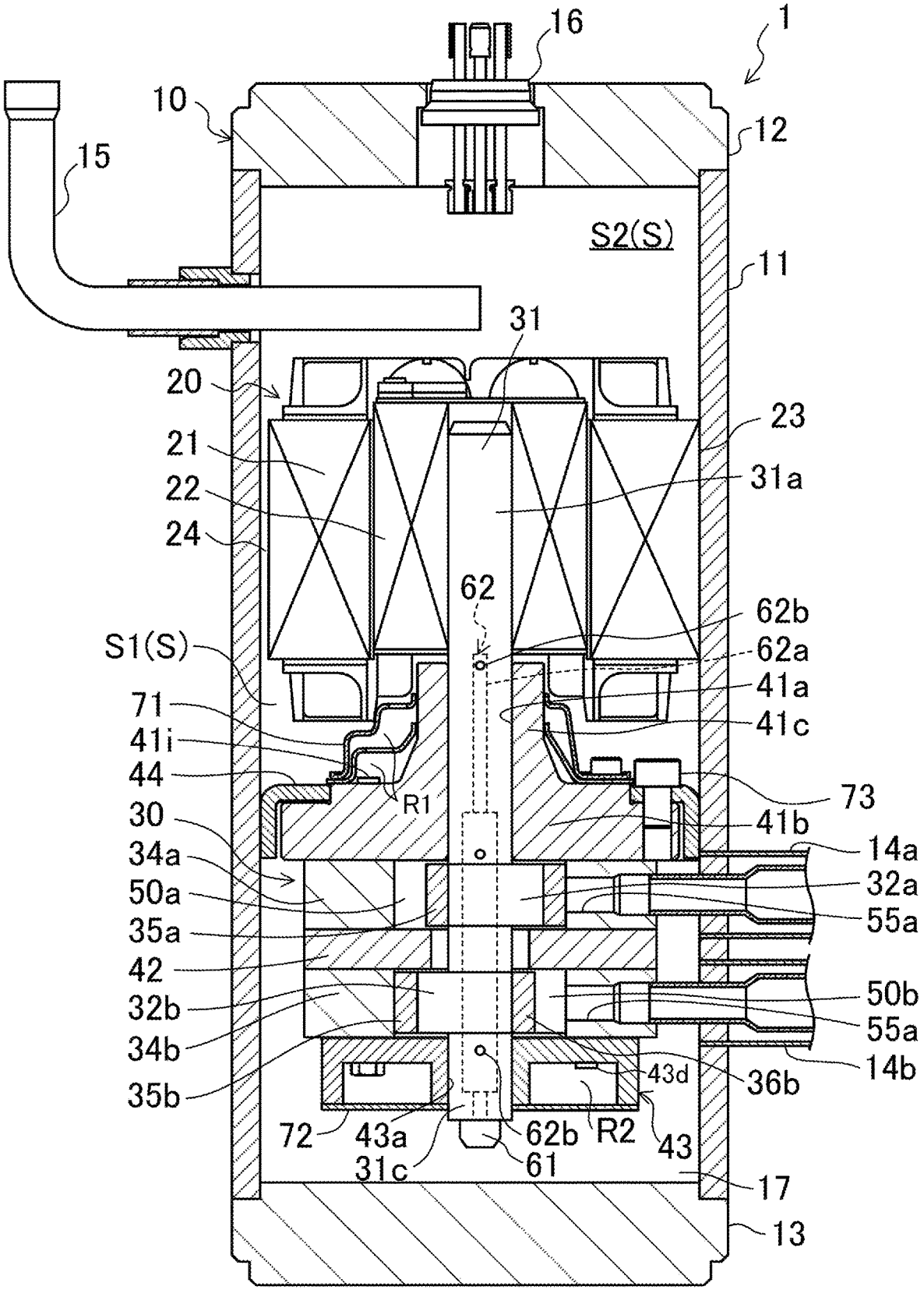
FIG. 1 is a longitudinal sectional view of a compressor according to an embodiment.
Figure 2:
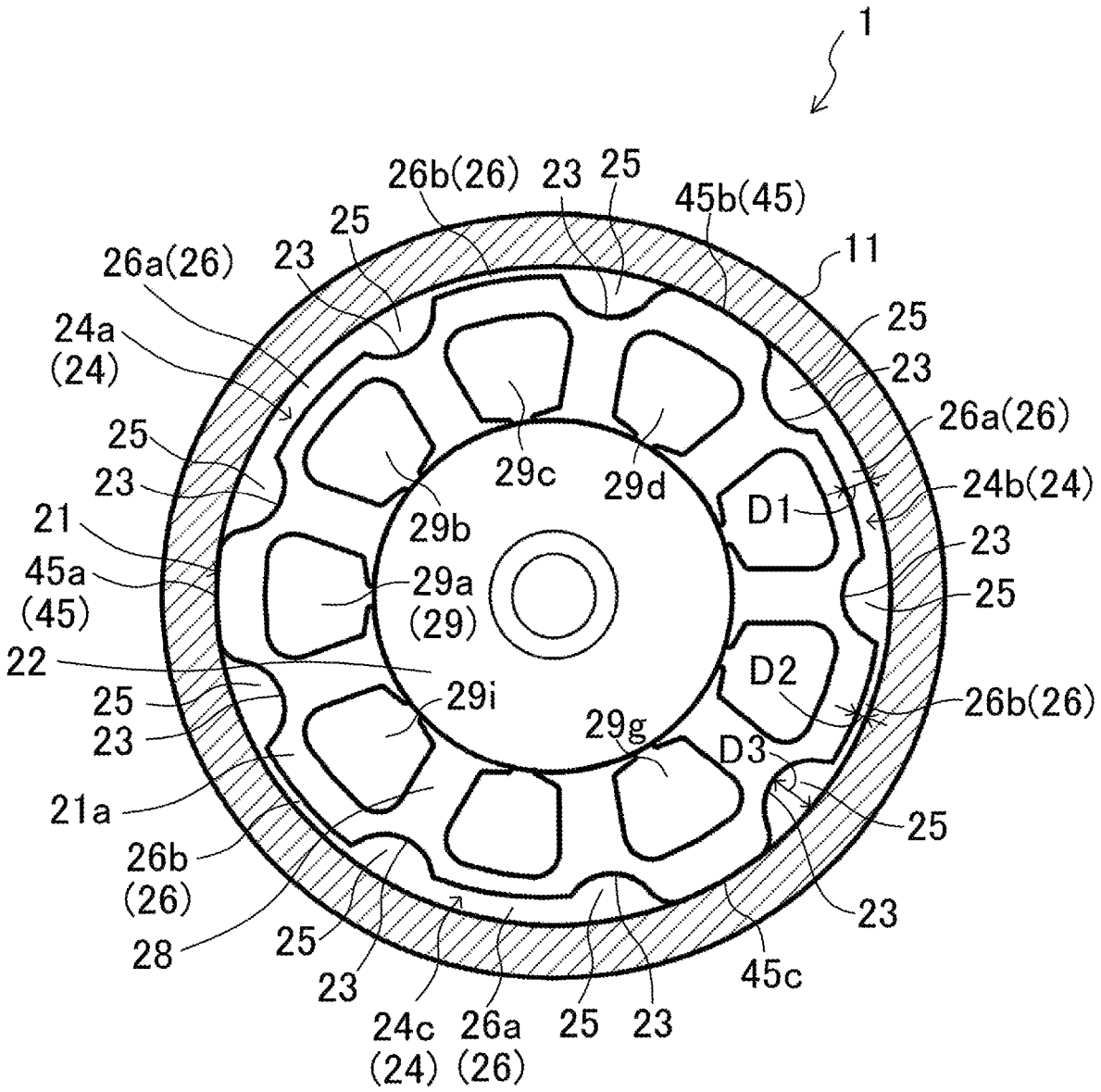
FIG. 2 illustrates an electric motor viewed from above.

A compressor (1) of the present embodiment is a rotary compressor. The compressor (1) is connected to a refrigerant circuit (not shown) that circulates a refrigerant to perform a refrigeration cycle, thereby compressing the refrigerant. As illustrated in FIGS. 1 and 2, the compressor (1) includes a casing (10), a, an electric motor (20), and a compression mechanism (30). The electric motor (20) and the compression mechanism (30) are housed in the casing (10). The compressor (1) is configured as a so-called high-pressure dome-shaped compressor where the refrigerant compressed in the compression mechanism (30) is discharged into the internal space (S) of the casing (10) and the pressure inside the internal space (S) becomes high. The refrigerant is a fluid of the present disclosure.

The casing (10) is a closed container. The casing (10) includes a cylindrical barrel (11) extending in the top-to-bottom direction, an upper end plate (12) that closes an upper end of the barrel (11), a lower end plate (13) that closes a lower end of the barrel (11). The upper end plate (12) and the lower end plate are formed to be thick. The barrel (11) has, at its lower portion, a suction pipe (14). The upper end plate (12) has a discharge pipe (15) and a terminal (16) for supplying electric power to the electric motor (20). The casing (10) has, at is bottom, an oil reservoir (17). The oil reservoir (17) stores lubricant for lubricating sliding components inside the compression mechanism (30). On substantially the middle of the inner peripheral surface of the barrel (11), a mounting plate (44) is fixed. The mounting plate (44) is a disk-shaped member. An oil passage through which the lubricant passes is provided in a portion of an outer edge of the mounting plate (44). The lubricant supplied to the sliding components passes through the oil passage and is again stored in the oil reservoir (17).

The electric motor (20) is housed in the casing (10). The electric motor (20) drives the compression mechanism (30). The electric motor (20) is disposed above the mounting plate (44) inside the electric motor (20). The internal space (S) is partitioned into a first internal space (S1) in a lower portion of the electric motor (20) and a second internal space (S2) in an upper portion of the electric motor (20). The electric motor (20) has a tubular stator (21) along the inner peripheral surface of the barrel (11) and a rotor (22) disposed inside the stator (21).

The stator (21) has a stator core (21*a*) and a stator coil (not shown). The stator core (21*a*) is a substantially tubular member. The stator core (21*a*) includes a single back yoke (27) and a plurality of teeth (28). The back yoke (27)) is an outer peripheral portion of the stator core (21*a*), and is annular when viewed in plan. The teeth (28) extend radially inward from the inner peripheral surface of the back yoke (27). The teeth (28) are arranged at predetermined pitches in the circumferential direction of the stator core (21*a*). Slots (29) for housing the stator coil (not shown) are provided between the circumferentially adjacent teeth (28). In the stator core (21*a*) of the present disclosure, nine slots (29), including a first slot (29*a*) to a ninth slot (29*i*), are provided clockwise when the stator core (21*a*) is viewed from above.

Core cuts (23) are provided in the outer peripheral surface of the stator core (21*a*). Specifically, the core cuts (23) are provided along the axial direction of the stator core (21*a*). Specifically, the core cuts (23) are each formed into a recessed groove shape recessed inward in the radial direction of the stator core (21*a*) between adjacent slots (29) in the circumferential direction. Each core cut (23) extends along the axial direction of the stator core (21*a*) from the lower end to the upper end of the stator core (21*a*).

Fluid passages (24) are provided between the outer peripheral surface of the stator core (21*a*) and the inner peripheral surface of the barrel (11). Each fluid passage (24) extends from one end to the other end of the stator (21). A fluid discharged from the compression mechanism (30) flows through the fluid passage (24). The fluid passage (24) will be described in detail later.

The compression mechanism (30) is housed in the casing (10). The compression mechanism (30) compresses a fluid sucked and discharges the compressed fluid into the internal space (S) of the casing (10). Specifically, the compression mechanism (30) is disposed on the lower surface of the mounting plate (44), and is fastened with the mounting plate (44) and a bolt (73). The compression mechanism (30) includes a drive shaft (31), a first cylinder (34*a*), a second cylinder (34*b*), a front head (41), a middle plate (42), a rear head (43), a first piston (35*a*), and a second piston (35*b*).

The drive shaft (31) is disposed to extend in the top-to-bottom direction in the casing (10). An upper portion of the drive shaft (31) is connected to a rotor (22) of the electric motor (20). A lower portion of the drive shaft (31) includes, in order from top to bottom, an upper shaft portion (31*a*), a first eccentric portion (32*a*), an intermediate shaft portion (31*b*), a second eccentric portion (32*b*), and a lower shaft portion (31*c*). The first eccentric portion (32*a*) and the second eccentric portion (32*b*) are eccentric with the shaft center of the drive shaft (31) so that the rotational phase difference is 180 degrees from each other. The first eccentric portion (32*a*) and the second eccentric portion (32*b*) are provided to have larger diameters than the upper shaft portion (31*a*), the intermediate shaft portion (31*b*), and the lower shaft portion (31*c*).

An oil pump (61) is fixed to the lower end of the drive shaft (31). The oil pump (61) sucks lubricant in the oil reservoir (17). An oil supply passage (62) is provided inside the drive shaft (31). The oil supply passage (62) is a passage through which the lubricant sucked by the oil pump (61) flows. The oil supply passage (62) includes a main oil supply path (62*a*) and a plurality of oil supply openings (62*b*). The main oil supply path (62*a*) extends in the top-to-bottom direction, and the lower end of the main oil supply path (62*a*) communicates with the oil pump (61). The oil supply openings (62*b*) extend radially outward at the middle of the main oil supply path (62*a*), and the outer peripheral ends of the oil supply openings (62*b*) are open to the side surface of the drive shaft (31). With this configuration, the lubricant in the oil reservoir (17) is supplied to sliding portions of the drive shaft (31) and the pistons (35*a*, 35*b*).

Figure 3:
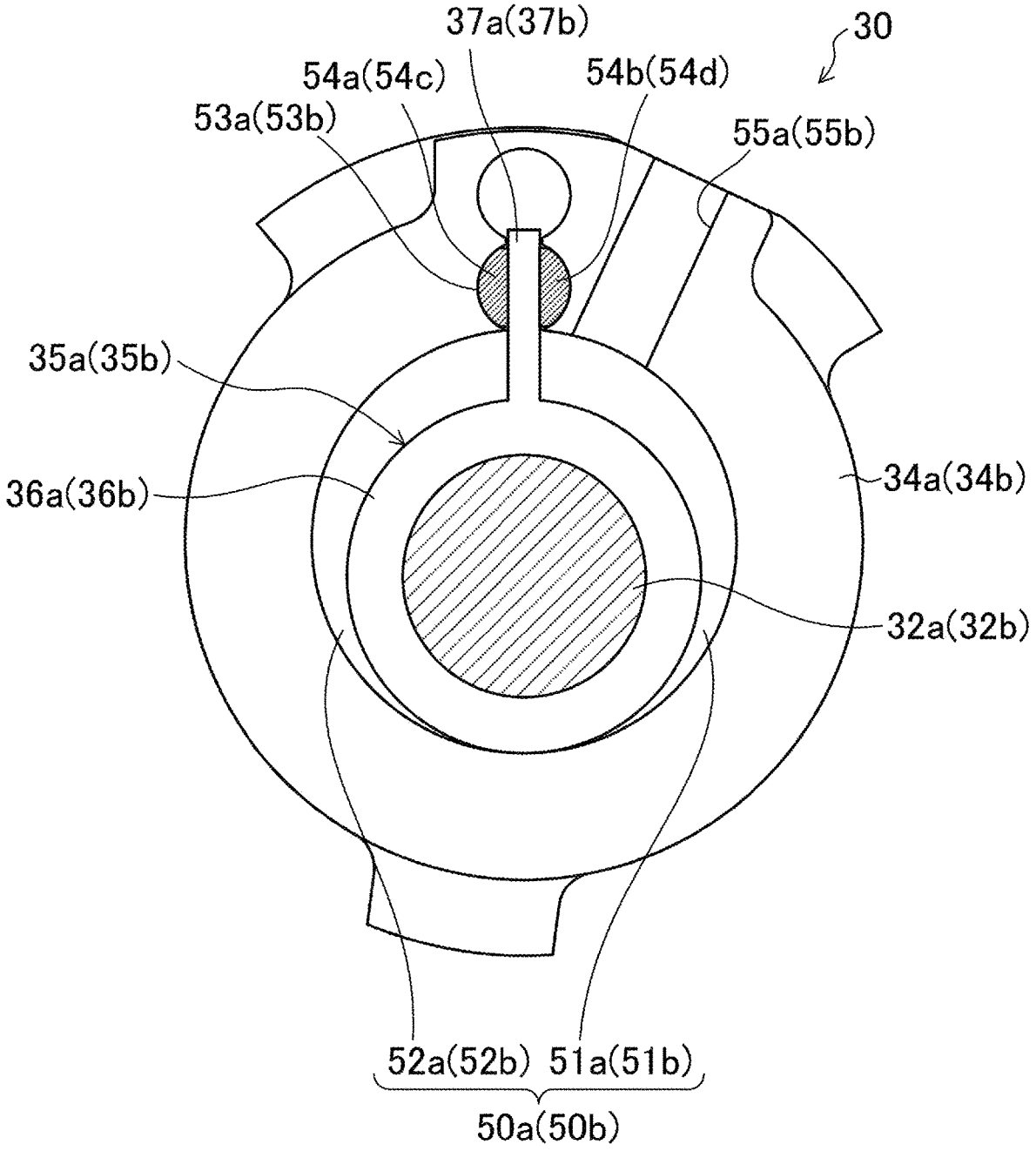
FIG. 3 is a plan view of a piston.

As shown in FIG. 3, the first cylinder (34*a*) and the second cylinder (34*b*) are each formed into a substantially cylindrical shape. The shaft of the first cylinder (34*a*) and the shaft of the second cylinder (34*b*) extend in the top-to-bottom direction. The second cylinder (34*b*) is disposed below the first cylinder (34*a*). The first eccentric portion (32*a*) of the drive shaft (31) is inserted into the first cylinder (34*a*), and the second eccentric portion (32*b*) of the drive shaft (31) is inserted into the second cylinder (34*b*).

The first piston (35*a*) is housed in the first cylinder (34*a*). The first piston (35*a*) is configured to slide to both a upper front head (41) and a lower middle plate (42). The first piston (35*a*) includes a first piston body (36*a*) and a first blade (37*a*).

The first piston body (36*a*) is formed in an annular shape. Specifically, the first piston body (36*a*) is formed in a slightly thick cylindrical shape. The first eccentric portion (32*a*) of the drive shaft (31) is slidably inserted into the first piston body (36*a*). The first piston body (36*a*) is configured to revolve along the inner peripheral surface of the first cylinder (34*a*) when the drive shaft (31) rotates. A first compression chamber (50*a*) is provided between the first piston body (36*a*) and the first cylinder (34*a*).

The first blade (37*a*) is integral with the first piston body (36*a*). The first blade (37*a*) protrudes radially outward from the outer peripheral surface of the first piston body (36*a*). The first blade (37*a*) is sandwiched between a pair of first swing bushes (54*a*, 54*b*) provided in a first bush groove (53*a*) extending radially outward from the inner peripheral surface of the first cylinder (34*a*). The first blade (37*a*) is configured to restrict rotation of the first piston body (36*a*) when the first piston body (36*a*) revolves. The first blade (37*a*) partitions the first compression chamber (50*a*) into a first low-pressure chamber (51*a*) and a first high-pressure chamber (52*a*).

The first cylinder (34*a*) has a first suction port (55*a*) penetrating in the radial direction of the first cylinder (34*a*). The inner peripheral end of the first suction port (55*a*) communicates with the first low-pressure chamber (51*a*), and the outer peripheral end of the first suction port (55*a*) is connected to a first suction pipe (14*a*).

The second piston (35*b*) is housed in the second cylinder (34*b*), and is configured to slide to both the upper middle plate (42) and the lower rear head (43). As shown in FIG. 2, the second piston (35*b*) and the first piston (35*a*) have the same configuration. Specifically, the second piston (35*b*) has a second piston body (36*b*) and a second blade (37*b*).

The second piston body (36*b*) is formed in an annular shape. Specifically, the second piston body (36*b*) is formed in a slightly thick cylindrical shape. The second eccentric portion (32*b*) of the drive shaft (31) is slidably inserted into the second piston body (36*b*). The second piston body (36*b*) is configured to revolve along the inner peripheral surface of the second cylinder (34*b*) when the drive shaft (31) rotates. A second compression chamber (50*b*) is provided between the second piston body (36*b*) and the second cylinder (34*b*).

The second blade (37*b*) is integral with the second piston body (36*b*). The second blade (37*b*) protrudes radially outward from the outer peripheral surface of the second piston body (36*b*). The second blade (37*b*) is sandwiched between a pair of second swing bushes (54*c*, 54*d*) provided in a second bush groove (53*b*) extending radially outward from the inner peripheral surface of the second cylinder (34*b*). The second blade (37*b*) is configured to restrict rotation of the second piston body (36*b*) when the second piston body (36*b*) revolves. The second blade (37*b*) partitions the second compression chamber (50*b*) into a second low-pressure chamber (51*b*) and a second high-pressure chamber (52*b*).

The second cylinder (34*b*) has a second suction port (55*b*) penetrating in the radial direction of the second cylinder (34*b*). The inner peripheral end of the second suction port (55*b*) communicates with the second low-pressure chamber (51*b*), and the outer peripheral end of the second suction port (55*b*) is connected to a second suction pipe (14*b*).

The front head (41) is fastened to the upper end of a cylinder (34) with a bolt (73). The front head (41) closes the upper end of the cylinder (34). This front head (41) has an upper bearing (41*a*) and a first discharge valve (41*i*). The upper bearing (41*a*) is formed into a cylindrical shape. The upper bearing (41*a*) rotatably supports the upper shaft portion (31*a*) of the drive shaft (31). The first discharge valve (41*i*) is a valve provided at a discharge port (not shown) allowing the first high-pressure chamber (52*a*) and the first muffler chamber (R1) to be described later to communicate with each other. The first discharge valve (41*i*) is configured to open when the pressure of the refrigerant in the first high-pressure chamber (52*a*) reaches a predetermined value or higher.

A front muffler (71) is fixed to the front head (41). The front muffler (71) is provided to cover the first discharge valve (41*i*). The first muffler chamber (R1) is provided between the front muffler (71) and the front head (41). The first muffler chamber (R1) communicates with the first high-pressure chamber (52*a*) and the second high-pressure chamber (52*b*). The front muffler (71) has a communication hole (not shown) allowing the first muffler chamber (R1) and the first internal space (S1) to communicate with each other.

The middle plate (42) is fixed to the lower end of the first cylinder (34*a*) and the upper end of the second cylinder (34*b*) to close the lower end of the first cylinder (34*a*) and the upper end of the second cylinder (34*b*). The intermediate shaft portion (31*b*) of the drive shaft (31) is inserted into the middle plate (42).

The rear head (43) is fastened to the lower end of the cylinder (34) with a bolt (not shown). The rear head (43) closes the lower end of the cylinder (34). The rear head (43) has a lower bearing (43*a*) and a second discharge valve (43*d*). The lower bearing (43*a*) is formed into a cylindrical shape. The lower bearing (43*a*) rotatably supports the lower shaft portion (31*c*) of the drive shaft (31). The second discharge valve (43*d*) is a valve provided at a discharge port (not shown) allowing the second high-pressure chamber (52*b*) and a second muffler chamber (R2) to communicate with each other. The second discharge valve (43*d*) is configured to open when the pressure of the refrigerant in the second high-pressure chamber (52*b*) reaches a predetermined value or higher.

A rear muffler (72) is fixed to the rear head (43). The rear muffler (72) is provided to cover the second discharge valve (43*d*). The second muffler chamber (R2) is provided between the rear head (43) and the rear muffler (72). The second muffler chamber (R2) communicates with the first muffler chamber (R1) via a communication passage (not shown).

Fluid Passage

As shown in FIG. 2, the fluid passages (24) are provided between the outer peripheral surface of the stator core (21*a*) and the inner peripheral surface of the barrel (11). The fluid passage (24) will be described in detail below.

Joint portions (45) are provided on the outer peripheral surface of the stator core (21*a*). The joint portions (45) are in contact with the inner peripheral surface of the barrel (11), and are joined to the barrel (11) by welding. The stator core (21*a*) of the present disclosure is provided with three joint portions (45) (a first joint portion (45*a*) to a third joint portion (45*c*)). Each joint portion (45) extends from one end to the other end of the stator core (21*a*).

Three joint portions (45) are arranged at approximately equal intervals in the circumferential direction of the stator core (21*a*). Strictly speaking, among the first slot (29*a*) to the ninth slot (29*i*) arranged clockwise, the first joint portion (45*a*) is a portion of the outer peripheral surface of the stator core (21*a*) on the outside of the first joint portion (45*a*). The second joint portion (45*b*) is a portion of the outer peripheral surface of the stator core (21*a*) on the outside of the fourth slot (29*d*). The third joint portion (45*c*) is a portion of the outer peripheral surface of the stator core (21*a*) on the outside of the seventh slot (29*g*).

The fluid passages (24) and the joint portions (45) are arranged alternately along the circumferential direction of the stator core (21*a*). Strictly speaking, the compressor (1) of the present disclosure is provided with three fluid passages (a first fluid passage (24*a*) to a third fluid passages (24*c*)). The first fluid passage (24*a*) is provided between the first joint portion (45*a*) and the second joint portion (45*b*). The second fluid passage (24*b*) is provided between the second joint portion (45*b*) and the third joint portion (45*c*). The third fluid passages (24*c*) is provided between the third joint portion (45*c*) and the first joint portion (45*a*). Each of the fluid passages (24*a* to 24*c*) has the same shape.

Specifically, each fluid passage (24) has three wide portions (25) and two narrow portions (26). The wide portions (25) are spaces between the respective core cuts (23) and the inner peripheral surface of the barrel (11) facing the core cuts.

The narrow portions (26) are spaces between the inner peripheral surface of the barrel (11) and portions of the outer peripheral surface of the stator core (21*a*) on the outsides of the respective slots (29) except the first slot (29*a*), the fourth slot (29*d*), and the seventh slot (29*g*). Each narrow portion (26) is provided between adjacent wide portions (25). With this configuration, the wide portions (25) and the narrow portions (26) are arranged alternately along the circumferential direction of the stator core (21*a*).

The two narrow portions (26) are provided so that the forward narrow portion (26) in the direction of rotation of the rotor (22) has a smaller width in the radial direction of the stator (21). Specifically, one of the two narrow portions (26) is referred to as a first narrow portion (26*a*), and the other is referred to as the second narrow portion (26*b*). The second narrow portion (26*b*) is located forward of the first narrow portion (26*a*) in the clockwise direction when the electric motor (20) is viewed from above. The rotor (22) of the present disclosure rotates clockwise when the electric motor (20) is viewed from above. Thus, the width D2 of the second narrow portion (26*b*) in the radial direction is smaller than the width D1 of the first narrow portion (26*a*) in the radial direction.

For example, in the first fluid passage (24*a*), the first narrow portion (26*a*) is provided between the outer surface of the second slot (29*b*) and the inner peripheral surface of the barrel (11). The second narrow portion (26*b*) is provided between the outer surface of the third slot (29*c*) and the inner peripheral surface of the barrel (11).

The width D1 of the first narrow portion (26*a*) in the radial direction is smaller than the width D3 of each of the wide portions (25) in the radial direction. Strictly speaking, the largest width D3 among the widths of the wide portions (25) in the radial direction is larger than the width D1 of the first narrow portion (26*a*) in the radial direction.

As described above, in each fluid passage (24), the wide portion (25), the first narrow portion (26*a*), the wide portion (25), the second narrow portion (26*b*), and the wide portion (25) are formed clockwise. The second fluid passage (24*b*) and the third fluid passage (24*c*) each have the same configuration as the first fluid passage (24*a*).

Operation

Figure 4:
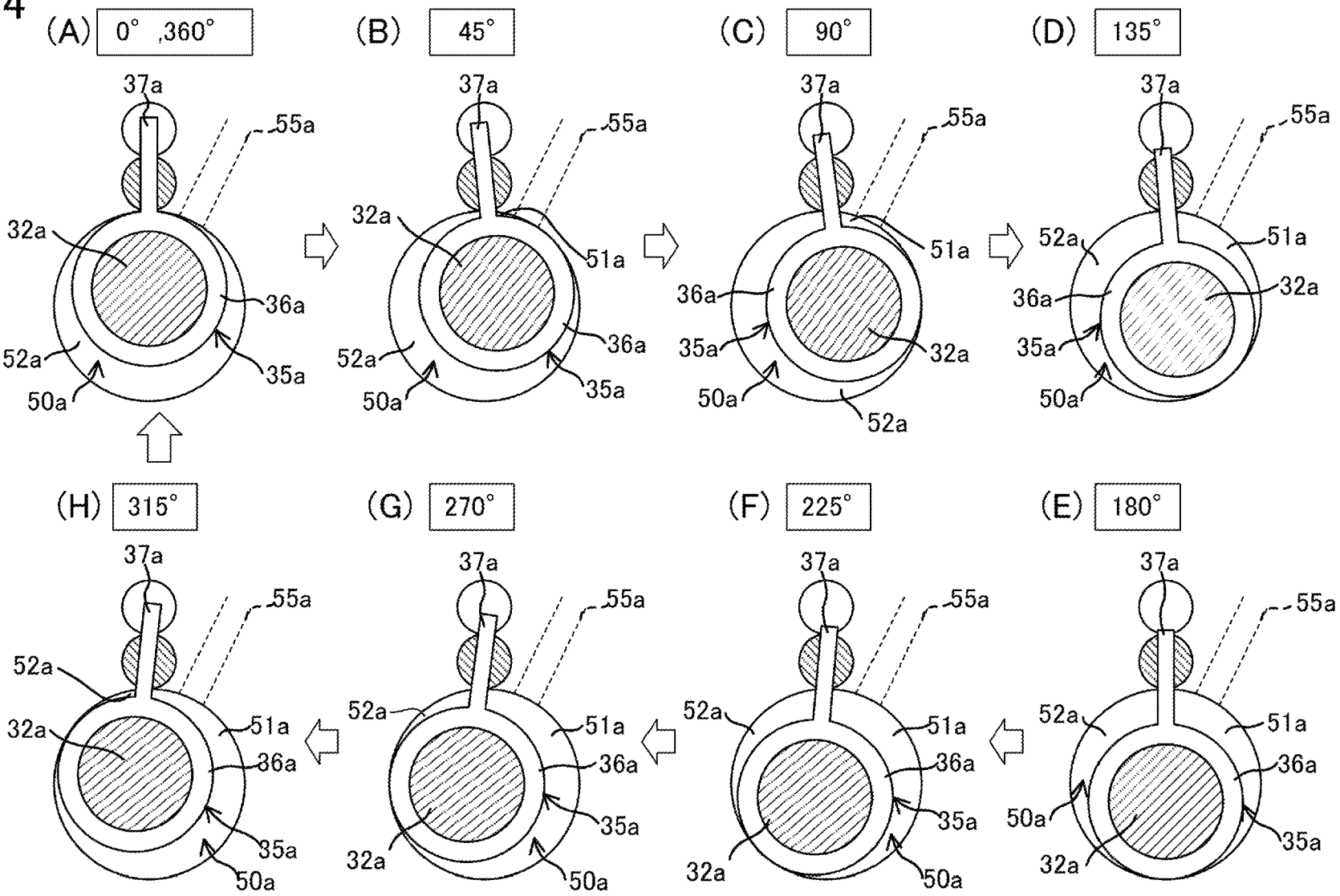
FIG. 4 illustrates the operation of a compression mechanism.

As shown in FIG. 4, in the compressor (1), when the electric motor (20) is activated to rotate the rotor (22), the drive shaft (31) rotates, and two eccentric portions (32*a*, 32*b*) rotate eccentrically while maintaining a rotational phase difference of 180 degrees. With the eccentric rotation of the eccentric portions (32*a*, 32*b*), two pistons (34*a*, 35*b*) revolve along the inner peripheral surfaces of cylinders (34*a*, 34*b*) while restricting the rotation of two pistons (34*a*, 35*b*).

A suction stroke of sucking the refrigerant into the first compression chamber (50*a*) will now be described below. When the drive shaft (31) slightly rotates from the state (the state of (A) in FIG. 4) of the rotational angle of 0°, a contact portion between the first piston (35*a*) and the first cylinder (34*a*) passes by the inner peripheral end of the first suction port (55*a*). At this time, suction of the refrigerant into the first low-pressure chamber (51*a*) is started.

The refrigerant is sucked through the first suction pipe (14*a*) via the first suction port (55*a*). With the increase in the rotational angle of the drive shaft (31), the capacity of the first low-pressure chamber (51*a*) increases, thereby increasing the amount of the refrigerant sucked into the first low-pressure chamber (51*a*) (the states shown in (B) to (H) of FIG. 4). The suction stroke for the refrigerant continues until the rotational angle of the drive shaft (31) reaches 360°, and thereafter shifts to the discharge stroke. The suction stroke for the refrigerant in the second compression chamber (50*b*) is the same as the suction stroke in the first compression chamber (50*a*).

Next, the discharge stroke of compressing the refrigerant in the first compression chamber (50*a*) and discharging the compressed refrigerant will be described below. When the drive shaft (31) slightly rotates from the state (the state of (A) in FIG. 4) of the rotational angle of 0°, a contact portion between the first piston (35*a*) and the first cylinder (34*a*) again passes by the inner peripheral end of the first suction port (55*a*). At this time, confinement of the refrigerant in the first low-pressure chamber (51*a*) is completed.

The first low-pressure chamber (51*a*) in connection with the first suction port (55*a*) is changed to the first high-pressure chamber (52*a*) in connection with only the discharge port (not shown). From this state, the compression of the refrigerant in the first high-pressure chamber (52*a*) is started. With the increase in the rotational angle of the drive shaft (31), the capacity of the first high-pressure chamber (52*a*) decreases, and the pressure in the first high-pressure chamber (52*a*) increases. When the pressure in the first high-pressure chamber (52*a*) reaches a predetermined pressure or more, the discharge valve (41*d*) is open. At this time, the refrigerant in the first high-pressure chamber (52*a*) is discharged into the first muffler chamber (R1) via the discharge port (not shown). Also in the second compression chamber (50*b*), the same discharge stroke as in the first compression chamber (50*a*) is conducted. The refrigerant in the second high-pressure chamber (52*b*) is discharged into the second muffler chamber (R2) via the discharge port (not shown). The refrigerant discharged into the second muffler chamber (R2) passes through a communication passage (not shown), and merges with the refrigerant in the first muffler chamber (R1).

The refrigerant in the first muffler chamber (R1) is discharged into the first internal space (S1). The refrigerant passes through the core cuts (23) and gaps between the stator (21) and the rotor (22), and flows into the second internal space (S2). The gas refrigerant that has flowed into the second internal space (S2) is discharged outside of the compressor (1) via the discharge pipe (15). The discharge stroke for the refrigerant continues until the rotational angle of the drive shaft (31) reaches 360°, and thereafter shifts to the suction stroke.

As described above, in the compressor (1), in each compression chamber (50*a*, 50*b*), the suction stroke and the discharge stroke are alternately performed, whereby the operation of compressing the refrigerant is continuously performed.

Flow of Refrigerant Gas

As described above, the refrigerant that has been compressed in the compression mechanism (30*a*, 30*b*) is discharged from the first muffler chamber (R1) to the internal space (S1). Thus, the pressure of the lubricant stored in the oil reservoir (17) of the casing (10) is substantially identical to the pressure of the high-pressure refrigerant discharged from the compression mechanism (30) to the internal space (S1) of the casing (10).

The high-pressure lubricant in the oil reservoir (17) passes through the oil supply passage (62) of the drive shaft (31) and is supplied to the compression mechanism (30). The high-pressure lubricant that has been supplied to the compression mechanism (30) flows into a gap between the upper shaft portion (31*a*) and the drive shaft (31), the gap between the lower shaft portion (31*c*) and the drive shaft (31), a gap between the first eccentric portion (32*a*) and the first piston (35*a*), and a gap between the second eccentric portion (32*b*) and the second piston (35*b*). The high-pressure lubricant that has been supplied to the compression mechanism (30) also flows into a gap between the upper end surface of the first piston (35*a*) and the front head (41) and a gap between the lower end surface of the second piston (35*b*) and the rear head (43).

Figure 5:
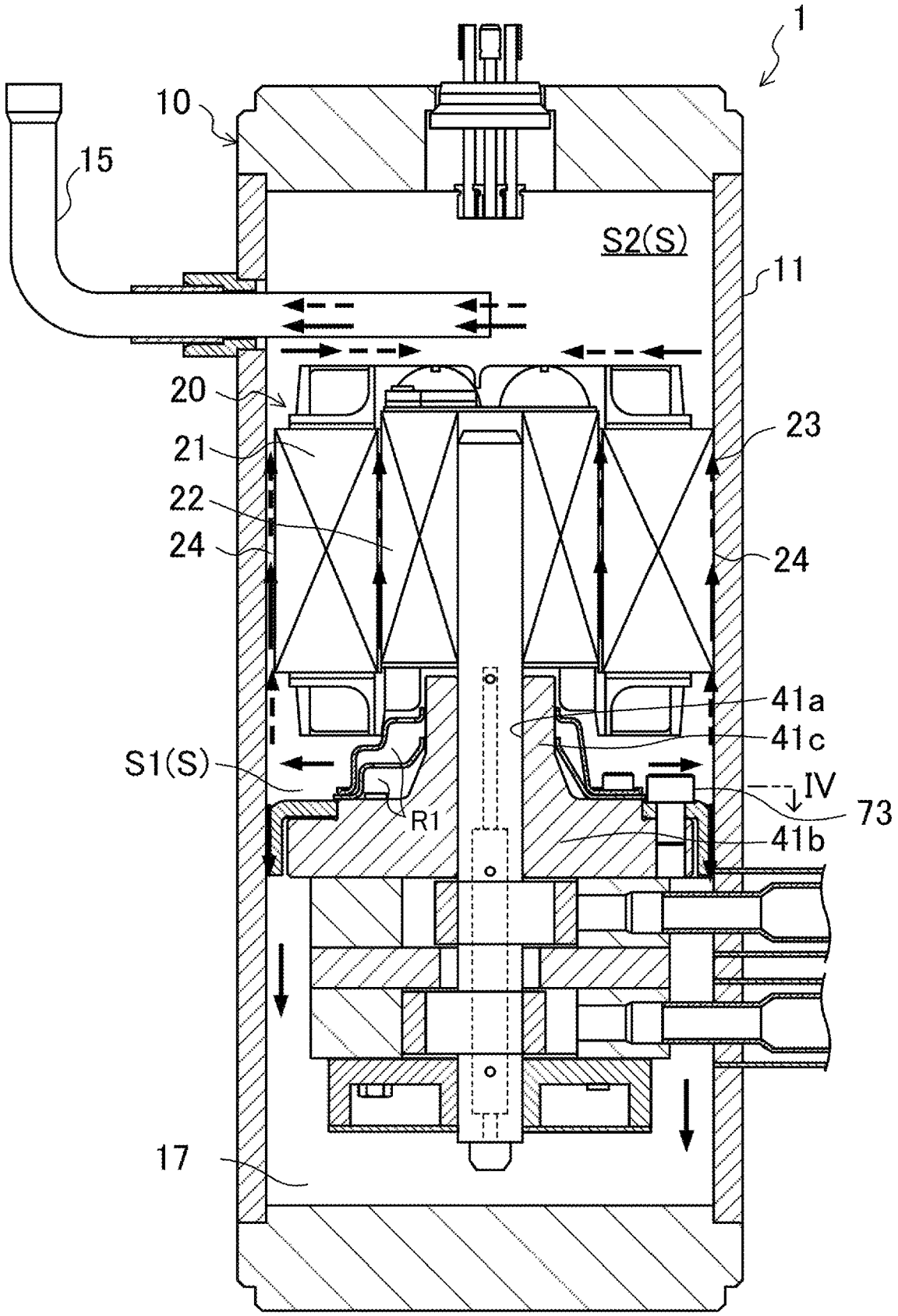
FIG. 5 is a diagram illustrating flows of a refrigerant gas and lubricant in the compressor.
Figure 6:
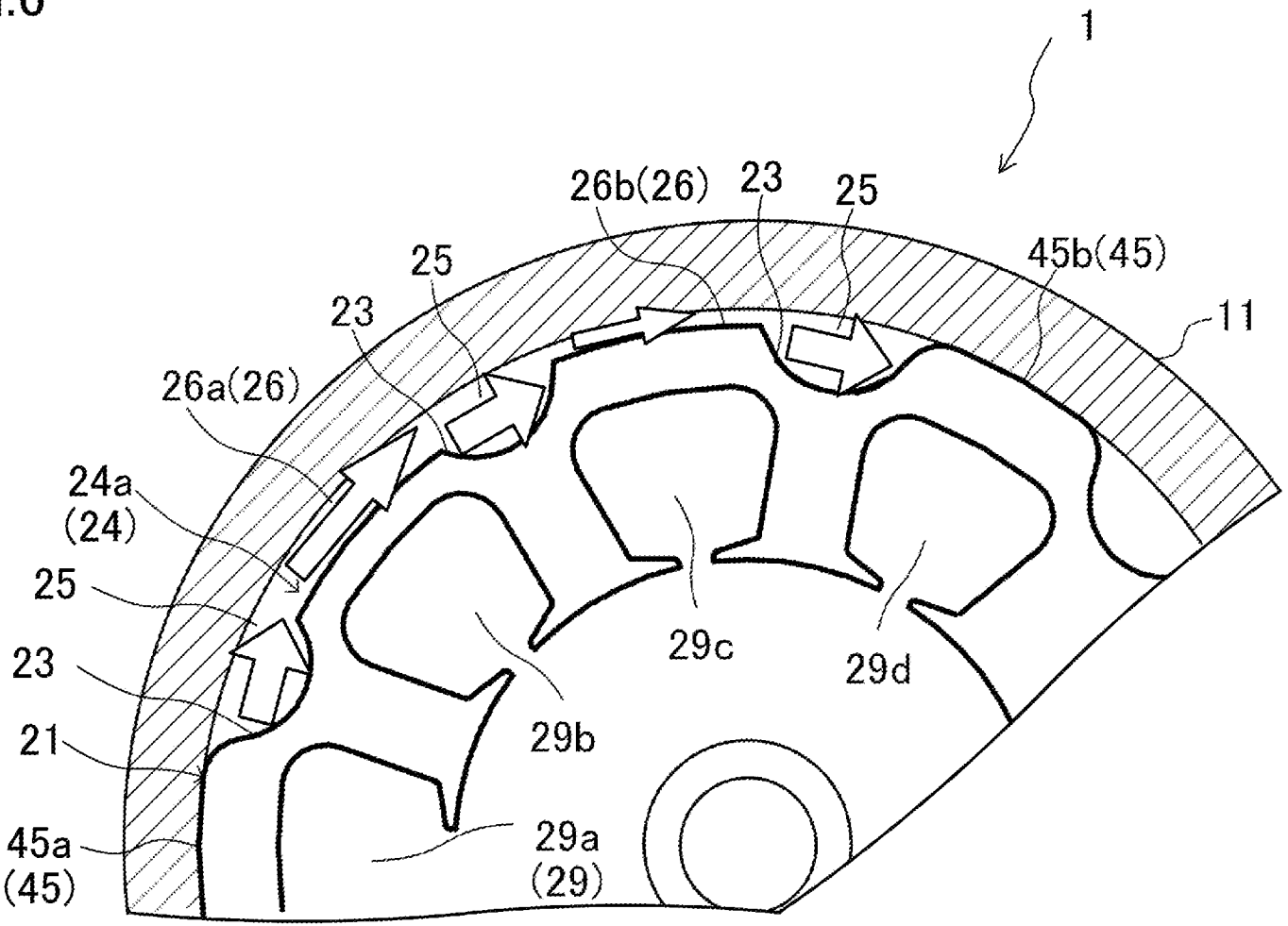
FIG. 6 is a diagram illustrating flows of a refrigerant gas and lubricant in a fluid passage.

As shown in FIGS. 5 and 6, part of the oil that has been supplied to the compression mechanism (30) is mixed with the refrigerant gas that has been discharged into the first internal space (S1), and then flows into each fluid passage (24). The solid arrows in FIG. 5 indicate the flow of the lubricant, and the dotted arrows indicate the flow of the refrigerant gas. The arrows in FIG. 6 show the flows of the lubricant and the refrigerant gas. The rotor (22) rotates clockwise. Thus, the refrigerant gas that has flowed into the fluid passages (24) rises while flowing clockwise through the fluid passages (24). Specifically, the refrigerant gas rises in the fluid passages (24) while flowing through the wide portion (25), the first narrow portion (26*a*), the wide portion (25), the second narrow portion (26*b*), and the wide portion (25) in this order. The refrigerant gas that has risen in the fluid passages (24) flows into the second internal space (S2), and flows out of the compressor (1) through the discharge pipe (15).

Problem of Oil Return

The lubricant that has supplied to each sliding portion of the compression mechanism flows from the first internal space (S1) into the second internal space (S2) through core cuts (23), the stator core (21*a*), and the rotor (22), together with the refrigerant gas discharged from the compression mechanism to the first internal space (S1). In this case, the lubricant that has been rolled up by the refrigerant gas and flowed into the second internal space (S2) drops through the core cuts (23) due to its own weight and is stored in the oil reservoir (17). However, when the refrigerant gas flows at a high flow velocity, the lubricant is rolled up by the refrigerant gas and is less likely to return to the oil reservoir (17). Thus, part of the lubricant tends to flow out of the compressor through the discharge pipe together with the refrigerant gas. When the lubricant flows out of the compressor (1), the amount of the lubricant stored in the compressor (1) may become too small.

Effect of Reducing Amount of Lubricant Flowing Out

In order to solve the problem, in the compressor (1) of the present embodiment, fluid passages (24) each extending from one end to the other end of the stator (21) and through which the fluid discharged from the compression mechanism (30) pass are provided between the outer peripheral surface of the stator (21) and the inner peripheral surface of the barrel (11). Each fluid passage (24) includes a plurality of wide portions (25) arranged in the circumferential direction of the stator (21) and narrow portions (26) which are provided between adjacent wide portions (25) and each have a width in the radial direction of the stator (21) smaller than those of the wide portions (25).

As shown in FIG. 6, when the rotor (22) rotates, the refrigerant gas containing the lubricant alternately flows through the wide portions (25) and the narrow portions (26) of each fluid passage (24) along the outer peripheral surface of the stator (21). Each narrow portion (26) has a smaller width in the radial direction of the stator (21) than each wide portion (25). Thus, when the refrigerant gas flows through the wide portion (25) into the narrow portions (26), the flow velocity of the refrigerant gas increases. When the refrigerant gas flows through the narrow portions (26) into the wide portions (25), the flow velocity of the refrigerant gas decreases. Compared to the refrigerant gas that flows from the narrow portions (26) to the wide portions (25) and then decelerates, the lubricant having a specific gravity larger than the refrigerant gas cannot rapidly decelerate and thus is easily separated from the refrigerant gas. The separated refrigerant gas collides with the wall surfaces or the like of the core cuts (23), drops along the inner peripheral surfaces of the core cuts (23) and the barrel (11), and easily returns to the oil reservoir (17). This can reduce the amount of the lubricant that does not return to the oil reservoir (17) but is rolled up again into the internal space (S) by the refrigerant gas, and further reduce the amount of the lubricant flowing out of the compressor (1) together with the refrigerant gas.

In addition, the wide portions (25) and the narrow portions (26) are provided alternately in the circumferential direction of the stator (21). Thus, the refrigerant gas flowing through the fluid passages (24) repeatedly accelerated and decelerated. This can reliably promote separation of the lubricant from the refrigerant gas.

In the compressor (1) of the present embodiment, on the outer peripheral surface of the stator (21), joint portions (45) extending from one end to the other end of the stator (21) and in contact with the inner peripheral surface of the barrel (11) are provided. The joint portions (45) are in contact with the inner peripheral surface of the barrel (11). Thus, the flow of the refrigerant gas through the fluid passages (24) is blocked. This causes the refrigerant gas flowing in the circumferential direction of the stator (21) to collide with the core cuts (23) adjacent to the joint portions (45), so that the lubricant contained in the refrigerant gas adheres to the wall surface and is easily separated from the refrigerant gas.

In the compressor (1) of the present embodiment, the fluid passages (24) and the joint portions (45) are arranged alternately along the circumferential direction of the stator (21). With this configuration, the fluid passage (24) can be provided between portions of the joint portion (45) adjacent in the circumferential direction of the stator (21). As described above, a plurality of fluid passage (24) are provided in the circumferential direction of the stator core (21*a*). Thus, the refrigerant gas flowing into the fluid passages (24) can relatively quickly flow into the second internal space (S2).

In the compressor (1) of the present embodiment, the fluid passages (24) each have two or more narrow portions (26), and the two or more narrow portions (26) are provided so that the forward narrow portion (26) in the direction of rotation of the rotor (22) has a smaller width in the radial direction of the stator (21). A pressure loss occurs in the refrigerant gas containing lubricant by an amount corresponding to the deceleration of the refrigerant gas flowing from the wide portions (25) to the narrow portion (26). For example, if all the narrow portions (26) are designed to be relatively narrow, the pressure loss of the refrigerant gas increases. Of the refrigerant gas flowing circumferentially through the fluid passage (24), the upstream refrigerant gas contains relatively large oil droplets. The larger the oil droplets in the refrigerant gas, the more likely they are to be separated from the refrigerant gas even if the velocity difference between the refrigerant gas and the lubricant is relatively small when they flow from the wide portions (25) to the narrow portions (26). The widths of narrow portions (26) in the radial direction, at an upstream (front) side of the direction of rotation of the rotor (22) (in other words, the direction in which the refrigerant gas flows) are designed to be relatively larger. This allows a reduction in pressure loss of the refrigerant gas. The oil droplets contained in the refrigerant gas flowing in the direction of rotation of the rotor (22) become smaller as they flow from the narrow portions (26) to the wide portions (25). Thus, by narrowing the widths of the narrow portions (26) in the radial direction of the stator (21) stepwise, the lubricant is easily separated from the refrigerant gas, and the pressure loss occurred in the refrigerant gas can be reduced. As a result, a decrease in the compressor efficiency due to the increase in the pressure loss of the refrigerant gas is reduced, and the reduction in the compressor efficiency can be reduced.

OTHER EMBODIMENTS

The foregoing embodiment may be modified as follows.

The number of joint portions (45) is not limited to three. The number of joint portions (45) provided on the outer peripheral surface of the stator core (21*a*) may be two or less, or four or more. The joint portions (45) do not have to be arranged at equal intervals in the circumferential direction of the stator core (21*a*).

The joint portions (45) may be provided only in a portion from one end to the other end of the stator core (21*a*).

The joint portions (45) do not have to be parts of the outer peripheral surface of the stator core (21*a*). The joint portions (45) may be members provided separately.

The number of fluid passages (24) is not limited to three. The number of fluid passages (24) may be one, two or more, or four or more.

The number of wide portions (25) and narrow portions (26) provided in each fluid passage (24) is not limited. In the fluid passage (24), the wide portion (25) and the narrow portion (26) may be adjacent to each other in the direction of rotation of the rotor (22).

When three or more narrow portions (26) are provided inside the fluid passage (24), only some of the narrow portions (26) may be provided such that, the further forward the narrow portion (26) is in the direction of rotation of the rotor, the narrower its width in the radial direction of the stator (21) is. All narrow portions (26) may have the same width in the radial direction of the stator (21).

The outer peripheral surface of the stator core (21*a*) forming the narrow portions (26) do not have to be formed along the inner peripheral surface of the barrel (11). For example, the outer peripheral surface may be formed to be inclined when the stator core (21*a*) is viewed from above, or may be formed in a wave shape.

The compression mechanism of the compressor (1) may be a single cylinder compression mechanism including a pair of cylinders and a piston.

The compressor (1) may be a scroll compressor.

In the fluid passage (24), adjacent narrow portions (26, 26) may have different widths in the radial direction of the stator (21). For example, a plurality of narrow portions (26, 26, . . . , 26) may be provided such that their widths in the radial direction of the stator (21) increase toward the direction of rotation of the rotor (22). Specifically, the second narrow portion (26*b*) may have a larger width in the radial direction of the stator (21) than the first narrow portion (26*a*).

The width of each narrow portion (26) in the radial direction of the stator (21) may be wide enough to allow the refrigerant to circulate through the narrow portion (26) when the rotor (22) rotates. For example, the width of the narrow portion (26) in the radial direction of the stator (21) may be 0.1 mm or more, preferably 1 mm or more.

The width of the narrow portion (26) in the radial direction of the stator (21) is ⅙ to ⅔ of the width of each wide portion (25) in the radial direction of the stator (21).

While the embodiments and variations thereof have been described above, it will be understood that various changes in form and details may be made without departing from the spirit and scope of the claims. The embodiments and the variations thereof may be combined and replaced with each other without deteriorating intended functions of the present disclosure. The expressions of "first," "second," . . . described above are used to distinguish the terms to which these expressions are given, and do not limit the number and order of the terms.

As can be seen from the foregoing description, the present disclosure is useful for a compressor.

The invention claimed is:

1. A compressor comprising:

a casing having a cylindrical barrel, the casing being configured to store lubricant at a bottom of the casing, the casing being in a form of a closed container;

a compression mechanism housed in the casing, the compression mechanism being configured to compress a fluid sucked and to discharge the compressed fluid into an internal space of the casing; and an electric motor housed in the casing, the motor being configured to drive the compression mechanism, the electric motor having a tubular stator along an inner peripheral surface of the barrel, and a rotor disposed inside the stator, the stator having a back yoke forming an outer peripheral portion of the stator, a plurality of teeth extending radially inward from an inner peripheral surface of the back yoke, and slots each surrounded by adjacent ones of the teeth and the back yoke, a fluid passage extending from one end to an other end of the stator between an outer peripheral surface of the stator and the inner peripheral surface of the barrel, the fluid passage being configured to pass the fluid discharged from the compression mechanism therethrough, and the fluid passage having a plurality of wide portions arranged in a circumferential direction of the stator, and narrow portions provided between adjacent ones of the wide portions, the narrow portions having smaller widths in a radial direction of the stator than each of the wide portions, the narrow portions being spaces between the inner peripheral surface of the barrel and portions of the outer peripheral surface of the stator core on outsides of respective slots, the plurality of wide portions each being provided in the outer peripheral surface of the stator and between a core cut having a recessed groove shape recessed radially inward between adjacent ones of the slots and the inner peripheral surface of the barrel, the number of the wide portions corresponding to the number of teeth, and the number of narrow portions being smaller than the number of wide portions, and each tooth being at least partially circumferentially aligned with one of the wide portions such that a radial axis passing through the tooth also passes through one of the wide portions.

2. The compressor of claim 1, wherein a first width of the narrow portion in the radial direction of the stator is ⅙ to ⅔ of a second width of the wide portion in the radial direction of the stator.

3. The compressor of claim 1, further comprising:

a joint portion provided on the outer peripheral surface of the stator and in contact with the inner peripheral surface of the barrel from one end to the other end of the stator.

4. The compressor of claim 2, further comprising:

a joint portion provided on the outer peripheral surface of the stator and in contact with the inner peripheral surface of the barrel from one end to the other end of the stator.

5. The compressor of claim 3, wherein the fluid passage and the joint portion are arranged alternately along the circumferential direction of the stator.

6. The compressor of claim 4, wherein the fluid passage and the joint portion are arranged alternately along the circumferential direction of the stator.

7. The compressor of claim 1, wherein the narrow portion includes a first narrow portion and a second narrow portion arranged in order in a direction of rotation of the rotor, and the second narrow portion has a smaller width in the radial direction of the stator than the first narrow portion.

8. The compressor of claim 2, wherein the narrow portion includes a first narrow portion and a second narrow portion arranged in order in a direction of rotation of the rotor, and the second narrow portion has a smaller width in the radial direction of the stator than the first narrow portion.

* * * * *